United States Patent [19]

England, Jr. et al.

[11] 3,953,002

[45] Apr. 27, 1976

[54] MOTIONLESS MIXING DEVICE

[76] Inventors: Herbert C. England, Jr.; William C. Voigt, Jr., both of 5018 1st Ave. N., Birmingham, Ala. 35212

[22] Filed: Sept. 21, 1973

[21] Appl. No.: 399,377

[52] U.S. Cl. ..... 259/4 AB; 259/4 AC

[51] Int. Cl.[2] ..... B01F 15/02

[58] Field of Search ..... 259/4, 18, DIG. 30, 259/4 R, 4 A, 4 AB, 4 AC; 48/180; 138/42, 38

[56] References Cited

UNITED STATES PATENTS

| | | | |
|---|---|---|---|
| 2,081,612 | 5/1937 | Woodson | 138/38 |
| 3,286,992 | 11/1966 | Armeniades | 239/402 |
| 3,328,003 | 6/1967 | Chisholm | 138/42 |
| 3,664,638 | 5/1972 | Grout | 259/4 |
| 3,704,006 | 11/1972 | Grout | 259/4 |

*Primary Examiner*—Robert W. Jenkins
*Attorney, Agent, or Firm*—Newton, Hopkins & Ormsby

[57] ABSTRACT

A mixing device is disclosed for intermixing a plurality of fluids. The mixing device comprises a housing having a cylindrical bore through which the fluids may flow and a diffuser link supported centrally within the housing bore. A right-hand helical baffle is secured to one end of the diffuser link and a left-hand helical baffle secured to the other end of the link. An annulus is rigidly mounted to the housing within the bore with a set of twisted interwoven leaves projecting inwardly from the annulus towards the bore axis. A tube is secured to one of the helical baffles traversing the housing bore and having two slots disposed within the bore through which trace additives may be introduced into the mixing device.

4 Claims, 6 Drawing Figures

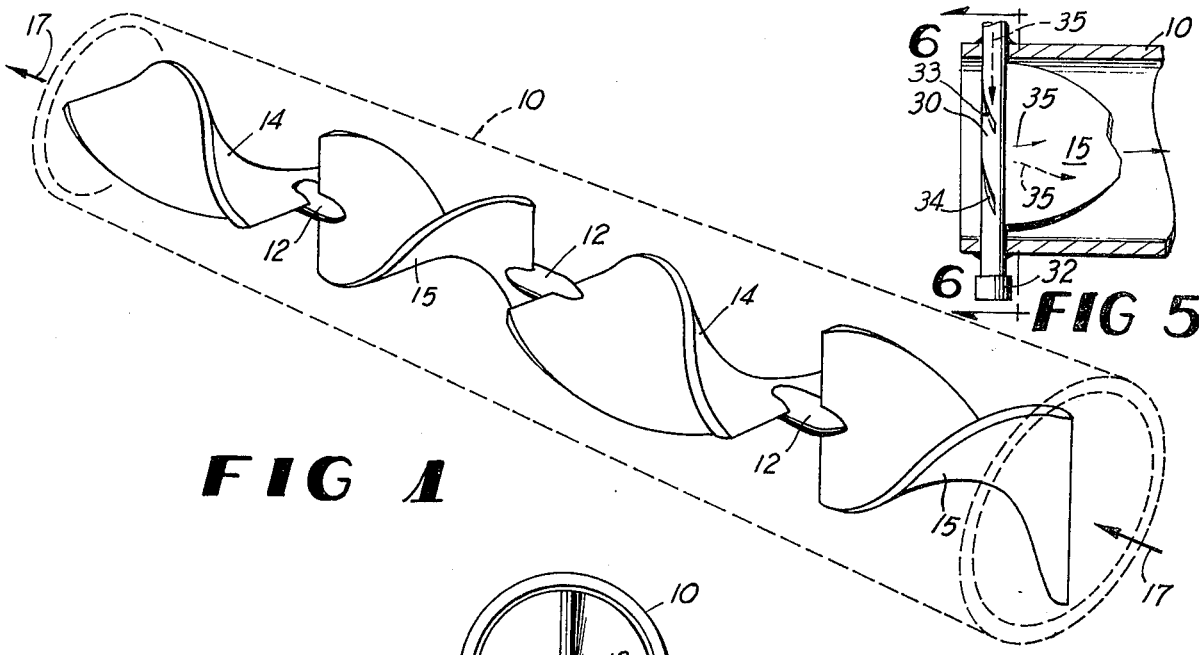
FIG 1
FIG 5
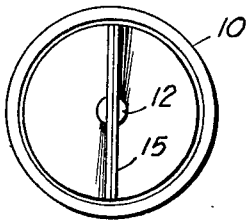
FIG 2
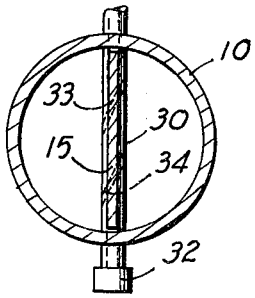
FIG 6
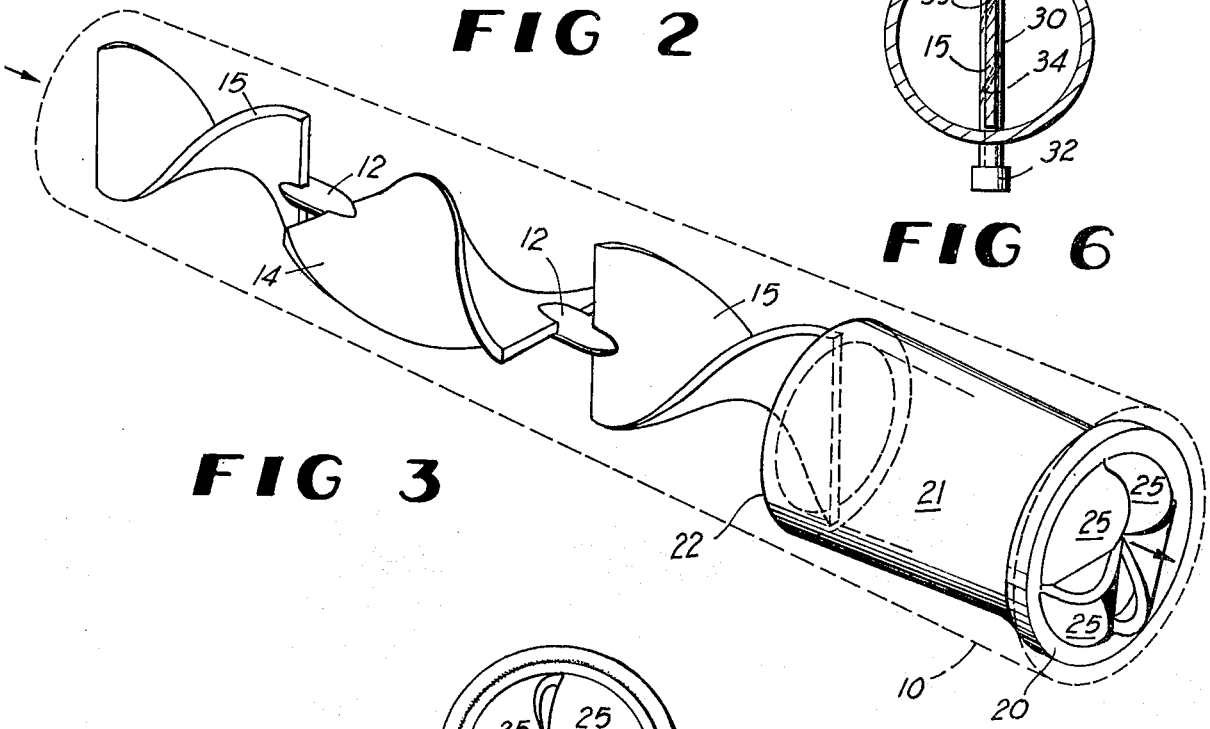
FIG 3
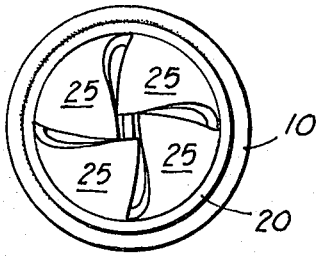
FIG 4

MOTIONLESS MIXING DEVICE

BACKGROUND OF THE INVENTION

This invention relates generally to mixing devices for intermixing a plurality of fluids, and more specifically to motionless type mixing devices which do not employ moving parts.

Heretofore, motionless mixing devices have typically comprised conduits through which fluids to be intermixed are directed and in which a series of baffles is housed. Representative examples of such motionless mixing devices are disclosed in U.S. Pat. Nos. 3,286,992, 3,664,638 and 3,704,006. Typically they include a cylindrical conduit in which is housed a set of curved sheet-like elements arranged in alternating right-hand and left-hand curvature groups. Such devices may be used to intermix liquid resinous components to form a dispersed resinous product.

Though motionless type mixing devices have met with success in intermixing many types of fluids in various proportions they have met with less success in mixing fluids of widely varying viscosities and relatively large volumetric ratios. For example, such devices would not be capable of effectively and efficiently mixing 1,000 parts of a polymer having a viscosity of 50,000 poise with one part of a dye solution having a viscosity of 1 centipoise, in an effective and efficient manner. To achieve a sufficient mixing of such fluids the device would have to be quite lengthy with an attendant increase in size and cost. These difficulties are typically attributable to the presence of center dead spots when fluid flow is substantially laminar and to channeling effects occurring along the surfaces of the baffles and conduits where little if any intermixing occurs. Relatively poor plug flow characteristics have also been commonly experienced. To achieve a more thorough mixing a succession of such motionless mixing devices could, of course, be employed but such would be done at the expense of attendant space losses and added costs. The practical alternative to this solution would be the addition of moving parts such as a set of rotating vanes which, of course, would necessitate inclusion of auxiliary power means.

Accordingly, it is a general object of the present invention to provide an improved mixing device for intermixing a plurality of flowing fluids.

More specifically, it is an object of the present invention to provide an improved motionless mixing device for intermixing a plurality of fluids having widely varying viscosities and high volumetric ratios.

Another object of the invention is to provide a motionless mixing device for intermixing a plurality of flowing fluids without creating regions of laminar flow within the device.

Another object of the invention is to provide a motionless mixing device for intermixing a plurality of fluids without creating regions of channelled flow within the device.

Another object of the invention is to provide a motionless mixing device of relatively small and economic construction.

SUMMARY OF THE INVENTION

In one form of the invention a mixing device is provided for intermixing a plurality of fluids. The device comprises a housing having a central bore through which the fluids may flow and a diffusion link supported centrally within the housing bore. The mixing device further comprises a righthand helical baffle secured to one end of the diffusal link and a left-hand helical baffle secured to the other end of the diffusal link.

BRIEF DESCRIPTION OF THE DRAWING

FIG. 1 is a perspective view of a motionless mixing device embodying principles of the present invention in one form;

FIG. 2 is an end view in elevation of the motionless mixing device shown in FIG. 1;

FIG. 3 is a perspective view of a motionless mixing device embodying principles of the invention in another form;

FIG. 4 is an end view in elevation of the motionless mixing device shown in FIG. 3;

FIG. 5 is an elevational view in cross section of a fragment of a motionless mixing device embodying principles of the invention in another form which fragment includes means for introducing trace additives into the mixing device;

FIG. 6 is a cross sectional end on view in elevation of the device shown in FIG. 5 taken along plane 6—6.

DETAILED DESCRIPTION OF THE DRAWING

Referring now in more detail to the drawings, there is shown in FIGS. 1 and 2 a motionless mixing device comprising a tubular housing 10 along the axis of which is supported a set of dispersion links 12. A set of right-hand helical baffles 14 and a set of left-hand helical baffles 15 are alternatively secured to the dispersion links. The resulting baffle and link chain is loosely disposed within tube 10 with longitudinal movement of the chain being restricted by unshown annuli secured to the bore defining interior walls of the tube or by alternative means to be described later in conjunction with the other figures.

In operation, a plurality of fluids are introduced into the device as indicated by arrows 17 passing against and over the helical baffles and dispersion links. The alternating spiral motion imparted to the fluid creates much intermixing. Dispersion links 12 divert fluid from the center to the periphery of the tube bore which has been found to create near ideal plug flow. This center to periphery dispersion has also been found to substantially reduce the presence of center dead spots where flow becomes substantially laminar and to break up channeling effects found both along the surface of the helical elements and the surface of the bore itself where flow also becomes substantially laminar with little, if any, intermixing occurring. In this respect it will be noted that the cross-sectional area of structure within the bore changes abruptly at the termination of each helical baffle which in turn creates a negative pressure condition that enhances mixing action.

The preferred shape of the dispersion links is generally cylindrical with each end being conical or bullet shaped. One preferred configuration provides a two to one ratio of maximum link diameter to link length with a diameter to length ratio of the helical elements being some three to two.

Turning next to FIGS. 3 and 4 an alternative embodiment of the invention is shown comprising a tubular housing, centrally disposed dispersion links, and alternating right-hand and left-hand helical baffles as in the just described mixing device. This embodiment however includes an annulus 20 rigidly secured as by welding to the bore defining interior cylindrical walls of tube 10. A truncated conical structure 21 projects from one side of annulus 20 within tube 10 into contact with the interior walls of the tube at cone end 22 which abuts the end of helical baffle 15. From the other end of annulus 20 projects a set of twisted interwoven leaves 25 projecting inwardly into the housing bore. The annulus, cone and interwoven leaves structure serves to divert the fluids flowing along the periphery of tube 10 inwardly and thereby break up channeling occurring along the bore periphery. In other words, this structure serves to converge the fluids towards the center of the device whereas dispersion links 12 serve to disperse the fluids from the center to the periphery. The combination of alternating swirls created by the helical baffles themselves plus the divergence of fluids created by the dispersion links and the convergence of fluids caused by the annulus, cone and interwoven leaves structure serves to achieve a very thorough intermixing of fluids within the relatively short distance and with a rather minimal number of structural elements.

Turning finally to FIGS. 5 and 6 yet another embodiment of the invention is shown which includes a set of dispersion links and helical baffles as shown in FIG. 1 together with means for introducing trace additives into the device. This trace introductory means includes a tubular element 30 which traverses tubular housing 10 and is plugged at one end by cap 32. Tube 30 has a longitudinal slot into which the end of helical baffle 50 is seated and rigidly secured. As seen most clearly by reference to FIG. 6 tube 30 is seen to comprise two or more substantially parallel slots 33 and 34 located about opposite sides of the axis of tubular housing 10 and the helical baffle. With this configuration trace additives may be introduced into housing 10 as shown by arrows 35. The fluids entering through slots 33 and 34 are caused to swirl in opposite directions and change directions of flow as they encounter the adjacent baffle resulting in excellent intermixing. In addition to providing the capability of introducing trace additives tube 30 also serves to inhibit longitudinal movement of adjacent baffles and links since tube 30 is rigidly secured to the housing. This dual function is also achieved by the annulus, conical and interwoven leave structure previously described in conjunction with FIGS. 3 and 4.

It should, of course, be understood that the just described embodiments merely illustrate principles of the invention in preferred forms. Many modifications may be made to the specifically described devices without departure from the spirit and scope of the invention as set forth in the following claims.

We claim:

1. A mixing device for intermixing a plurality of fluids and comprising:

a. a tubular housing having an interior wall defining a cylindrical bore through which fluid may flow;

b. a right-hand helical baffle disposed within said bore, said right-hand baffle having an edge extending across said bore, c. a left-hand helical baffle disposed within said bore and axially spaced from said right-hand helical baffle, said left hand helical baffle having an edge extending across said bore, the edge of said right-hand baffle being spaced from the edge of said left-hand edge, said edge of said left-hand baffle being angularly disposed with respect to said edge of said right hand baffle, and d. a circular diffusion link in only the central portion of said bore and spaced inwardly from the interior wall of said housing, said link being supported solely by its end portions being secured to and extending between the central portions of the adjacent edges of said left-hand baffle and said right-hand baffle for spacing these edges apart, said link tapering toward both of its ends and overlapping on both sides the central end portion of each of said central portions.

2. A mixing device in accordance with claim 1 wherein said diffuser link comprises a central portion and two end portions, and wherein one of said end portions is conical adjacent to the edge of one of said baffles.

3. A mixing device in accordance with claim 2 wherein said diffuser link cylindrical central portion has a predetermined maximum diameter, and wherein the length of said diffuser link is substantially two times said predetermined maximum diameter.

4. A mixing device in accordance with claim 1 wherein the length of each of said helical baffles is substantially one and a half times the diameter of each of said helical baffles.

* * * * *